US012146336B2

(12) United States Patent
Shires et al.

(10) Patent No.: US 12,146,336 B2
(45) Date of Patent: Nov. 19, 2024

(54) TENT SHELTER WITH APEX POLES PROPORTIONALLY DISPLACED RELATIVE TO A RECTANGULAR FOOTPRINT AND FACETED, POLE-SUPPORTED SIDEWALLS

(71) Applicant: Tarptent, Inc., Nevada City, CA (US)

(72) Inventors: Henry C. Shires, Nevada City, CA (US); Robert Dunne, Nevada City, CA (US)

(73) Assignee: TARPTENT, INC., Nevada City, CA (US)

( * ) Notice: Subject to any disclaimer, the term of this patent is extended or adjusted under 35 U.S.C. 154(b) by 171 days.

(21) Appl. No.: 17/893,934

(22) Filed: Aug. 23, 2022

(65) Prior Publication Data

US 2024/0068268 A1 Feb. 29, 2024

(51) Int. Cl.

| | |
|---|---|
| ***E04H 15/00*** | (2006.01) |
| ***E04H 15/44*** | (2006.01) |
| ***E04H 15/60*** | (2006.01) |
| ***E04H 15/62*** | (2006.01) |

(52) U.S. Cl.

CPC ..... *E04H 15/60* (2013.01); *E04H 15/00* (2013.01); *E04H 15/44* (2013.01); *E04H 15/62* (2013.01)

(58) Field of Classification Search

CPC ..... E04H 15/00; E04H 15/44

See application file for complete search history.

(56) References Cited

U.S. PATENT DOCUMENTS

| | | | | |
|---|---|---|---|---|
| 3,043,320 | A * | 7/1962 | Charles | E04H 15/44 D21/834 |
| 3,356,098 | A * | 12/1967 | Krutzikowsky | E04H 15/04 135/117 |
| 3,741,224 | A * | 6/1973 | Clelland | E04H 15/00 135/87 |
| 3,943,952 | A * | 3/1976 | Marquart | E04H 15/14 135/117 |
| 4,003,181 | A * | 1/1977 | Robinson | E04H 15/42 135/156 |
| 5,915,400 | A * | 6/1999 | Pohl | E04H 15/44 135/117 |
| 7,134,443 | B1 | 11/2006 | Shires | |
| 7,146,996 | B1 | 12/2006 | Shires | |

(Continued)

*Primary Examiner* — Noah Chandler Hawk

(74) *Attorney, Agent, or Firm* — Inventive Law Inc.; Jim H. Salter

(57) ABSTRACT

A tent shelter with apex poles proportionally displaced relative to a rectangular footprint and faceted, pole-supported sidewalls includes: a tent canopy having an outer perimeter defining a generally rectangular footprint, the tent canopy configured with corners at the outer perimeter for removable fastening of the tent canopy outer perimeter to a ground surface with no more than four stakes; two apex poles, the tent canopy having two main canopy peaks configured to receive tips of the two apex poles removably insertable therein, the two main canopy peaks and the two apex poles being displaced in a longitudinal displacement relative to the corners of the tent canopy outer perimeter, and two secondary support poles, the tent canopy also having two secondary canopy peaks configured with two secondary support poles erectable therein, the two secondary support poles configured to create oblique pyramids in faceted sidewalls of the tent canopy.

20 Claims, 12 Drawing Sheets

(56) References Cited

U.S. PATENT DOCUMENTS

| | | | | |
|---|---|---|---|---|
| 7,406,977 | B1 | 8/2008 | Shires | |
| 7,673,642 | B1 | 3/2010 | Shires | |
| 7,841,356 | B2 | 11/2010 | Shires | |
| 8,555,908 | B2 * | 10/2013 | Gross | E04H 15/46 280/820 |
| 8,684,020 | B1 | 4/2014 | Shires | |
| 11,105,113 | B2 | 8/2021 | Shires | |
| 2010/0243014 | A1 | 9/2010 | Shires | |
| 2020/0165835 | A1 | 5/2020 | Shires | |
| 2020/0208431 | A1 | 7/2020 | Durston | |

* cited by examiner

TENT SHELTER WITH APEX POLES PROPORTIONALLY DISPLACED RELATIVE TO A RECTANGULAR FOOTPRINT AND FACETED, POLE-SUPPORTED SIDEWALLS

COPYRIGHT

A portion of the disclosure of this patent document contains material that is subject to copyright protection. The copyright owner has no objection to the facsimile reproduction of the patent document or the patent disclosure, as it appears in the U.S. Patent and Trademark Office patent files or records, but otherwise reserves all copyright rights whatsoever. The following notice applies to the disclosure provided herein and to the drawings that form a part of this document: Copyright 2021-2022, Tarptent, Inc.; All Rights Reserved.

TECHNICAL FIELD

The disclosed subject matter relates to the field of portable tent and tarp shelters for hikers, backpackers, and campers. In particular, the present disclosure relates to a tent shelter with apex poles proportionally displaced relative to a rectangular footprint and faceted, pole-supported sidewalls.

BACKGROUND

Modified versions of the classic A-frame tent or tarp shelter are known, and include both floored and floorless styles. Modern shelters of this type commonly use a weatherproof nylon or polyester fabric "fly" (canopy) supported by two spaced upright poles, for example adjustable length hiking or "trekking" poles. The main body of the canopy defines a lengthwise, generally rectangular main floor plan or "footprint" between the poles, under which hikers can shelter and sleep, with vestibule end portions or a perimeter of the canopy staked down outwardly of the poles. The footprint for a tent is generally understood as the area enclosed by the outer tent perimeter. One or both of the vestibule ends usually includes a door. The canopy may be used alone as a floorless shelter, or in combination with an attached floor or inner tent made from varying fabrics.

Two poles erected at the peak ends of the canopy ridgeline support the ridgeline, while ground-level edges of the canopy are secured to the ground directly or through guy lines, using stakes or other fixed supports. The walls of the canopy generally slope directly toward the ground from the ridgeline and peaks, without vertical wall portions, and thus limit the interior useable space. Increasing the pole height and canopy slope angle for a given footprint increases useable space relative to the footprint, but can reduce the shelter's stability in wind and increase its weight. Generally available trekking poles limit practical maximum height to 145 cm (57 in.) or lower, absent separate trekking pole tip extenders.

As a practical matter, useable space is space where the canopy walls are high enough above the ground so that the occupants and their gear are not pressing against or distorting the canopy walls while inside. Although preferences will vary, a typical useable space can be defined as the interior volume where all canopy fabric is 12" (inches) or more above the ground. This allows room for feet and heads to be clear of the canopy fabric while sleeping.

However, conventional A-frame tent or tarp shelter configurations have limitations with respect to usable volume, unsupported panel spans, which collect wind and cause potentially severe structural deformations, and lack of views/venting though the low edges. In addition, a standard A-frame design requires at least six staking points—one at each canopy corner and one descending from each apex pole to prevent the apex poles from collapsing inwardly.

SUMMARY

A tent shelter with apex poles proportionally displaced relative to a rectangular footprint and faceted, pole-supported sidewalls is disclosed. In general, an improved A-frame tent design is disclosed, which eliminates the need for apex pole support lines and requires only four staking points. The disclosed improved A-frame tent design achieves these benefits by displacing or insetting the vertical apex poles relative to a location where the low canopy corners tension to the ground. This displaced apex pole configuration allows the tent fabric to exert outward horizontal forces on the apex pole tips, which prevents the apex poles from rotating inwardly or outwardly. An inward rotation of one of the apex support poles creates a significant sag and loss of surface tension in the tent structure. For example, a one inch inward rotation of an apex support pole causes a vertical deformation in the tent roof panel of over four inches and renders the tent structure essentially unusable without additional apex tension and stakes. By virtue of the displaced apex pole configuration of the example embodiments disclosed herein, there is no deformation in the tent structure and no need for apex pole support lines and corresponding apex pole support line staking points.

In an example embodiment, the apex pole displacement or offset is at least 10 inches. The relatively large offset affords significantly greater outward forces on the apex pole tips to lock the apex poles in place independently of any side door tension or tension from any lines coming off the apex. The relatively large offset enables the tent structure to resist strong wind and rain forces (or other environmental forces), which pull the apex poles causing inward rotation and tent deformation. The maximum or desired relative offset is not necessarily a fixed or limited number. The use of 10 inches or greater in an example is a compromise between strength, overall footprint (e.g., the space required for tent setup), and the desired capacity for gear storage. The relatively large offset also provides an advantage of a covered space outside of the living space within the tent. This covered outside space provides a place to cover backpacks and other gear and protects the interior of the tent when users enter or exit the tent during rain events. The covered outside space also provides a place to store potentially wet gear that a user would not want to store in the dry interior environment of the tent.

Additionally, the disclosed improved A-frame tent design addresses the usable volume and unsupported fabric span limitations of conventional A-frame tent designs. In particular, the disclosed improved A-frame tent design provides secondary supports and lift by use of secondary support poles (struts). The secondary supports not only increase the useable tent interior volume, but the secondary supports also create beneficial tension lines through the tent fabric. These tension lines create a plurality of isosceles trapezoids having two upper corners corresponding to two main canopy peaks, each isosceles trapezoid composed of four triangles offset from a plane of the isosceles trapezoid thereby forming an oblique pyramid with the isosceles trapezoid serving as a base of the oblique pyramid, the apex of each oblique pyramid corresponding to each of two secondary canopy peaks. The secondary support poles (struts), upon insertion into the secondary canopy peaks, tension the four triangles of each isosceles trapezoid at the apex of the oblique pyramid and along the edges of each triangle. As a result, the secondary support poles (struts) create beneficial tension at tension lines through the tent fabric. The tension lines create the individual triangles, facets, or panels, which partition the previously unsupported large tent fabric into a plurality of oblique pyramids having individual smaller panels, each of which has supported and tensioned edges. The result is a significantly stronger structure in wind and other environmental forces, and significantly more usable volume inside the tent. The design also creates vertical end walls and allows for views and ventilation along all edges, which is impossible or impractical with the conventional A-frame designs. In example embodiments, each secondary support pole (strut) can be a foldable carbon fiber tube of a folded length that is convenient to store and pack in a backpack. For example, in an example embodiment, the foldable strut can be configured in a stored size of the tent structure (e.g., 12 inches folded and rolled), which easily fits into any standard backpack. In other example embodiments, each secondary support pole (strut) can be any type of vertical support pole, such as a folded trekking pole, which is a viable option when users are carrying trekking poles or foldable arch poles.

In the example embodiments disclosed herein, the increased useable tent interior volume can be configured in a variety of ways. For example, the tent shelter can be configured as a "fly only" construction where the interior space is left open under the canopy. The tent shelter can also be configured as a "single wall" construction where interior walls and a floor can be sewn in under the canopy to frame the interior space of the tent and provide a closed interior space. Additionally, tent shelter can also be configured as a "double wall" construction where interior walls and a floor can be removably attached or clipped in under the canopy to frame the interior space of the tent and provide a closed interior space. Additionally, an example embodiment can include a mesh layer on a front panel to enable an optional complete sealed closure or vented closure of the front panel. Each of these configurations can be implemented and sized as a single person tent, a double person tent, or a multiple person tent accommodating or sheltering more than two people. By virtue of the tent structure disclosed herein, the various configurations of the tent shelter can vary and scale up or down as desired while maintaining structural integrity without the need for apex pole support lines and without the need for more than four staking points.

Thus, in the various example embodiments disclosed herein, the improved A-frame tent design eliminates the need for apex pole support lines and requires only four staking points, while expanding the useable space within the tent and increasing the structural integrity of the tent. The various example embodiments are described in more detail below.

BRIEF DESCRIPTION OF THE DRAWINGS

Embodiments are illustrated by way of example and not limitation in the figures of the accompanying drawings, in which.

DETAILED DESCRIPTION

In the following detailed description, reference is made to the accompanying drawings that form a part hereof, and in which are shown, by way of illustration, specific embodiments in which the disclosed subject matter can be practiced. It is understood that other embodiments may be utilized and structural changes may be made without departing from the scope of the disclosed subject matter.

Figure 1:
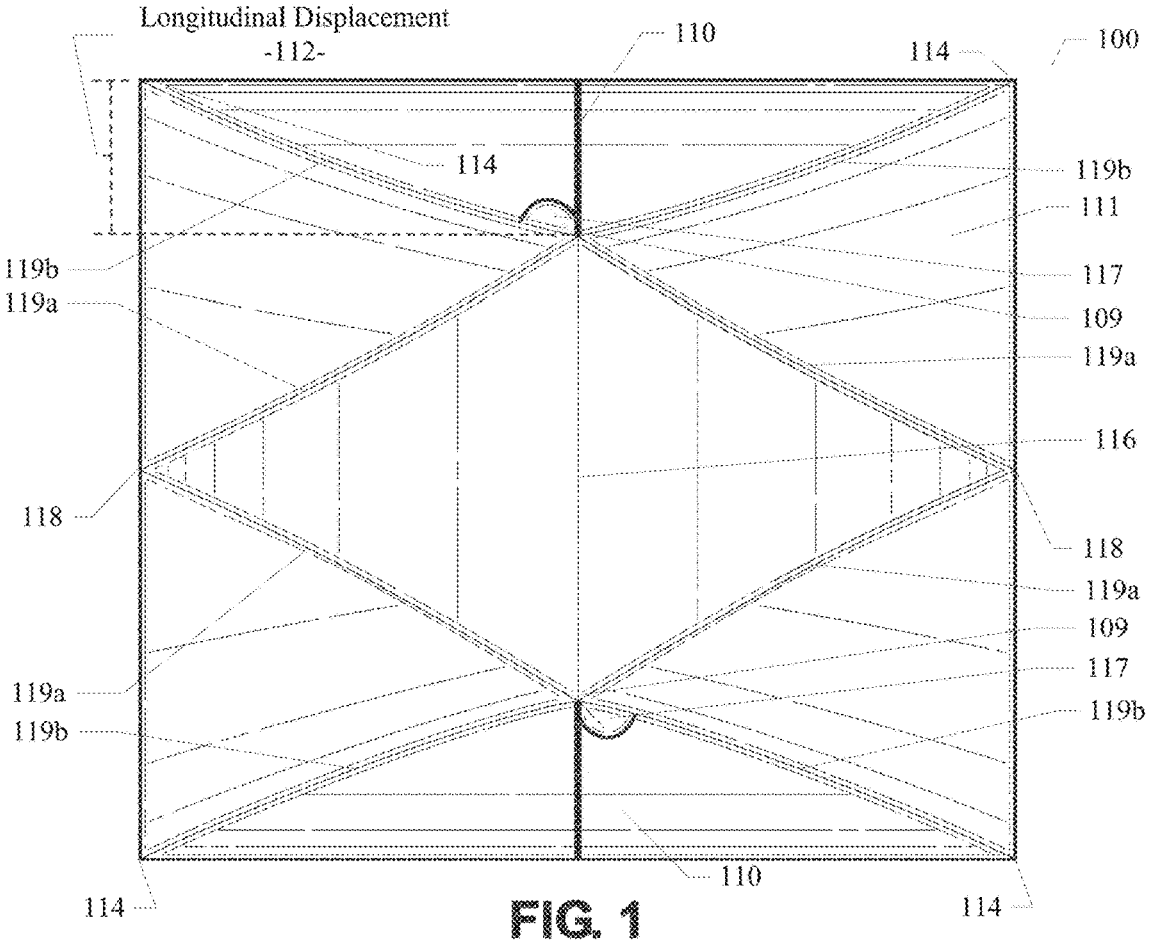
FIG. 1 illustrates a top-down view of an example embodiment of the tent shelter with apex poles proportionally displaced relative to a rectangular footprint and faceted, pole-supported sidewalls.
Figure 2:
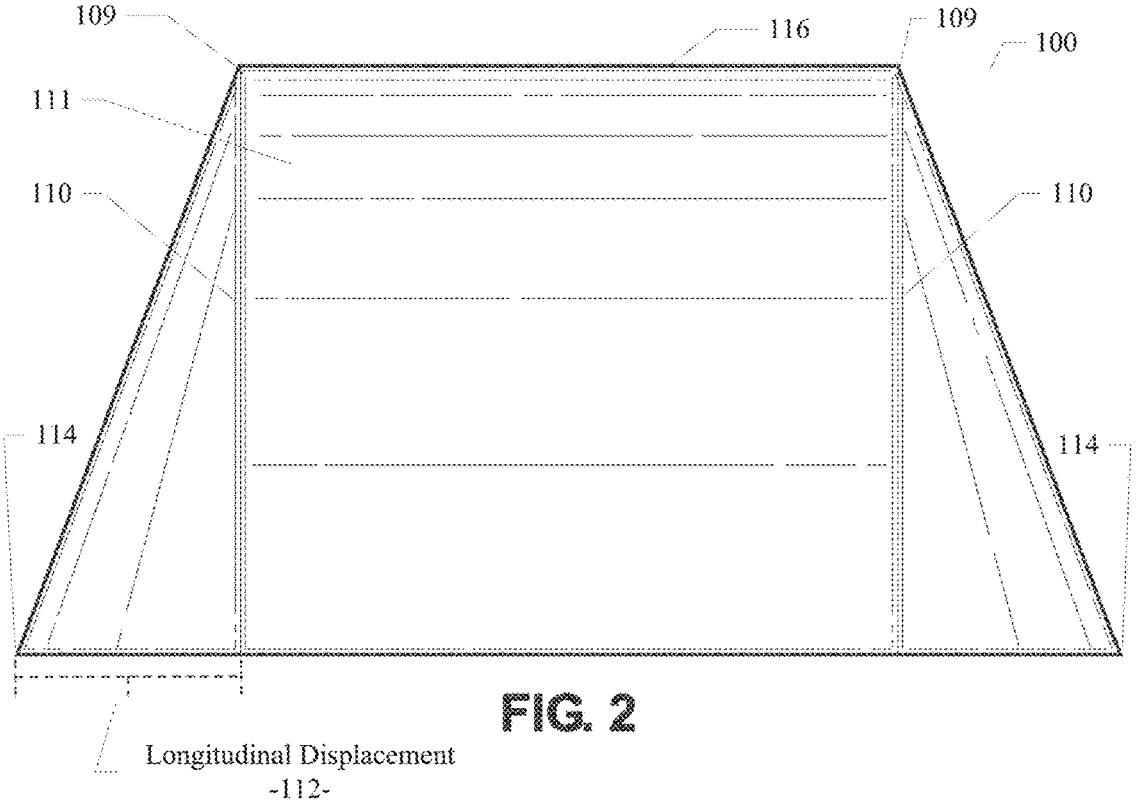
FIG. 2 illustrates a side view of an example embodiment of the tent shelter with apex poles proportionally displaced relative to a rectangular footprint and faceted, pole-supported sidewalls.

A tent shelter with apex poles proportionally displaced relative to a rectangular footprint and faceted, pole-supported sidewalls is disclosed. In general, an improved A-frame tent design is disclosed, which eliminates the need for apex pole support lines, adds additional pole support along the sides to facet the sides and enhance usable volume and structural support, while requiring only four staking points. Referring to FIGS. 1 and 2, the diagrams illustrate views of an example embodiment of the tent shelter 100 with displaced apex poles 110. In the example embodiment of shelter 100 shown, the shelter 100 includes a weatherproof canopy 111 defining a generally square or rectangular footprint enclosed by the outer perimeter of the canopy 111. In alternative embodiments, canopy 111 may have longer sides and shorter ends. Canopy 111 can be a weatherproof nylon, polyester, canvas, or other known tent canopy fabric and can include both floored and floorless styles. In general, the square or rectangular area defined under the main canopy 111 in its erected configuration is equal to or greater than the square or rectangular area of the footprint. The footprint can be fixed when the tent shelter 100 is erected by placing or fastening no more than four stakes to a ground surface at each of the four canopy corners 114 as shown in FIG. 1. The four staked canopy corners 114 define the location where the low canopy corners tension to the ground. The edges of the canopy 111 joining each of the four staked canopy corners 114 define the tent footprint.

It will be understood that when relative displacements or fabric dimensions and shapes are discussed herein, reasonable variations should be taken into account. Such known variations include approximations as to the non-rigid shape of structures formed largely from fabric; fabric tolerances; fabric finishing details (tie-out points, catenary cuts, rounded edges, bathtub floors); fabric tension variations under different weather conditions; deformation of the shelter from the ideal shape when set up on irregular terrain; and variations in set up and tensioning by people of different skill levels. Terms of shape, size, and orientation, such as rectangular, orthogonal, upright, triangular, equal length, and similar terms should be given reasonable interpretation because of such factors.

Canopy 111 includes two main canopy peaks 109 adapted to receive the ends of upright apex poles 110, which can be any form of a vertical support pole, such as adjustable-length hiking or "trekking" poles. For this purpose, main canopy peaks 109 may be shaped and reinforced with heavier or different fabric or other material, or may include pole-receiving structure, such as grommets or cups. Main canopy peaks 109 are joined by a ridgeline 116, which may be a straight- or catenary-cut seam, or a bias line in the canopy fabric when the shelter is erected. The ridgeline 116 is configured to run substantially orthogonally with sides of the generally rectangular footprint. Main canopy peaks 109 may be provided with vents 117.

The peaks of an A-frame type shelter can also be supported by suspending them in tension from an overhead support, such as a tree branch or poles braced in a V-shape over the peak. This is usually accomplished by running lines from grommets (not shown, but known) on the exterior of the peaks to the overhead support. Shelter 100 could also be supported in this fashion, and this manner of support should be included in the definition of pole-supported.

Canopy 111 further includes two secondary canopy peaks 118 adapted to receive the ends of secondary support poles (struts) 120, such as fixed-length or adjustable-length struts. For this purpose, secondary canopy peaks 118 may be shaped and reinforced with heavier or different fabric or other material, or may include pole-receiving structure, such as grommets or cups. The two secondary canopy peaks 118 are positioned substantially near mid-points of sides of the generally rectangular footprint as shown in FIG. 1. The two main canopy peaks 109 and the two secondary canopy peaks 118 are joined by tension lines 119*a*, which may be straight- or catenary-cut seams, or bias lines in the canopy fabric when the shelter 100 is erected. As shown in the top-down view of FIG. 1, the tension lines 119*a* create a generally diamond-shaped panel, along with a plurality of other triangular-shaped panels in canopy 111. Each of the two main canopy peaks 109 are also joined by tension lines 119*b*, which create the plurality of other triangular-shaped panels in canopy 111. When the tent shelter 100 is erected, these tension lines 119*a/b* and the related panels create stable, symmetrical tensioning of main canopy peaks 109, ridgeline 116, and secondary canopy peaks 118. In a particular example embodiment, the secondary support poles (struts) 120 can be semi-permanently attached at manufacture to the secondary canopy peaks 118 and configured to spring into full extension when the tent shelter 100 is unfolded and erected.

To give an idea of scale, a typical peak height for a tent shelter 100 designed to accommodate two sleeping people in a generally square or rectangular footprint would be in the range of forty to fifty inches or so off the ground, using a typical pair of adjustable apex poles 110 for support. The dimensions of shelter 100 can vary depending on the number of occupants for which the footprint is sized, and the desired ratios between interior room, height, weight and weatherworthiness (the latter dependent in part on the angle and tension of the canopy walls). These and other factors will be understood by those of ordinary skill in the art of portable tent and tarp shelters.

Tent shelter 100 is erected by securing at least the four corners 114 of the main canopy 111 to the ground, for example with stakes and/or guy lines. The corners 114 of the main canopy 111 can be provided with tie-out points of known type, which may include grommets, tabs, loops, pre-installed guy lines, or other known options for securing the corners to the ground. Then, apex poles 110 can be inserted upright through vents 117 or under the hem of the canopy 111 at ground level and into the main canopy peaks 109. Finally, the secondary support poles (struts) 120 can be inserted into the secondary canopy peaks 118. Typically, a length of the two apex poles 110 is greater than a length of the two secondary support poles 120. Also typically, the length of the two apex poles 110 is substantially equal while the length of the two secondary support poles 120 is substantially equal. As a result, the example embodiment provides an improved A-frame tent design that eliminates the need for apex pole 110 support lines and requires only four staking points at the four corners 114 of the main canopy 111, while expanding the useable space within the tent by use of the secondary support poles (struts) 120 and increasing the structural integrity of the tent 100.

Referring still to FIGS. 1 and 2, the disclosed improved A-frame tent shelter 100 achieves beneficial results by displacing or insetting the vertical apex poles 110 in a longitudinal displacement 112 relative to a location between the staked canopy corners 114 and the main canopy peaks 109 as shown in FIG. 1. This displaced apex pole 110 configuration or longitudinal displacement 112 allows the tent fabric and the tension lines 119*a/b* to exert outward horizontal forces on the tips of the apex poles 110, which prevents the apex poles 110 from rotating inwardly or outwardly. An inward rotation of one of the apex poles 110 creates a significant sag at ridgeline 116 and loss of surface tension in the tent 100 structure. For example, a one inch inward rotation of an apex pole 110 causes a vertical deformation in the tent roof panel of over four inches and renders the tent 100 structure essentially unusable without additional apex tension and stakes. By virtue of the displaced apex pole configuration or longitudinal displacement 112 of the example embodiments disclosed herein, there is no deformation in the tent 100 structure and no need for apex pole 110 support lines and corresponding apex pole 110 support line staking points. As shown in the side view of FIG. 2, the longitudinal displacement 112 of the apex poles 110 enables the staked corners 114, the tent fabric, and the tension lines 119*a/b* to exert outward horizontal forces on the tips of the apex poles 110, thereby preventing an undesired inward rotation of one or both of the apex poles 110. As a result, the tent structure 100 of an example embodiment retains tension at the ridgeline 116, which provides a stable and sturdy tent 100 and maximal useable space within the tent 100. These benefits of the tent structure 100 of the example embodiment are achieved without the need for a guy line attached to the tips of the apex poles 110 and without the use of more than four stakes to secure the tent structure 100.

In an example embodiment, the apex pole 110 displacement or longitudinal displacement 112 is at least 10 inches. In a particular example embodiment, the apex pole 110 displacement or longitudinal displacement 112 is 17 inches. The relatively large longitudinal displacement 112 affords significantly greater outward forces on the tips of the apex poles 110 to lock the apex poles 110 in place independently of any side door tension or tension from any lines coming off the apex. The relatively large longitudinal displacement 112 enables the tent 100 structure to resist strong wind and rain forces (or other environmental forces), which pull the apex poles 110 causing inward rotation and tent deformation. The maximum or desired longitudinal displacement 112 is not necessarily a fixed or limited number. The use of 10 inches or greater in an example embodiment is a compromise between strength, overall footprint (e.g., the space required for tent setup), and the desired capacity for gear storage. As shown in FIGS. 1 and 2, the relatively large longitudinal displacement 112 also provides an advantage of a covered space outside of the living space within the tent 100. This covered outside space provides a place to cover backpacks and other gear, and protects the interior of the tent 100 when users enter or exit the tent 100 during rain events. The covered outside space also provides a place to store potentially wet gear that a user would not want to store in the dry interior environment of the tent 100.

Figure 3:
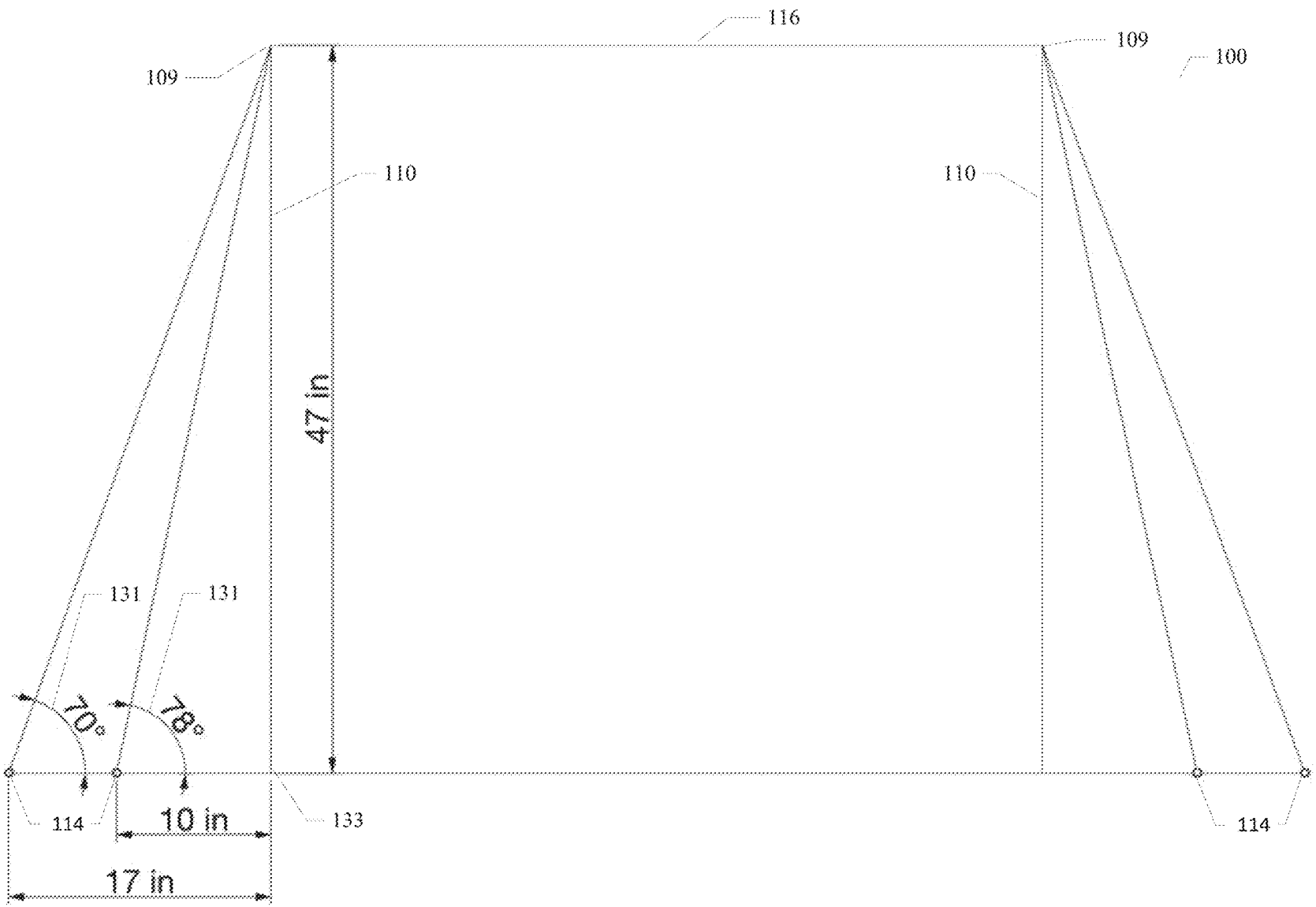
FIG. 3 illustrates a side view of an example embodiment of the tent shelter with apex poles proportionally displaced relative to a rectangular footprint and faceted, pole-supported sidewalls, the diagram showing variations of a longitudinal displacement angle.

FIG. 3 illustrates a side view of an example embodiment of the tent shelter 100 with apex poles 110 proportionally displaced based on a staked corner position 114 and apex pole height, the diagram showing variations of a longitudinal displacement angle 131. As shown in FIG. 3, a corner 114 of the generally rectangular footprint can be placed at various positions relative to a lower end 133 of the inserted apex pole 110. In the examples shown, the corner 114 can be displaced from 10 inches to 17 inches from the lower end 133 of the inserted apex pole 110. As also shown in FIG. 3, this displacement also creates a longitudinal displacement angle 131 formed by a first line connecting a corner 114 of the footprint with one of the two main canopy peaks 109 having one of the two apex poles 110 inserted therein, and a second line connecting the corner 114 of the footprint with a lower end 133 of the inserted apex pole 110. In the example embodiments shown, the displacement of the corner 114 relative to the apex pole 110 can create longitudinal displacement angles 131 of between 78 degrees and 70 degrees. In general, a longitudinal displacement angle 131 of less than or equal to 78 degrees is preferred to achieve the structural benefits of the tent shelter 100 as disclosed herein. It will be apparent to those of ordinary skill in the art in view of the disclosure herein that the size of the tent shelter 100 can scale up or down to accommodate a single person, two people, or more than two people, while maintaining a relatively constant longitudinal displacement angle 131 to retain the structural integrity of the tent shelter 100. In particular, the size of the tent shelter 100 can scale up or down relative to ridgeline 116.

Figure 4:
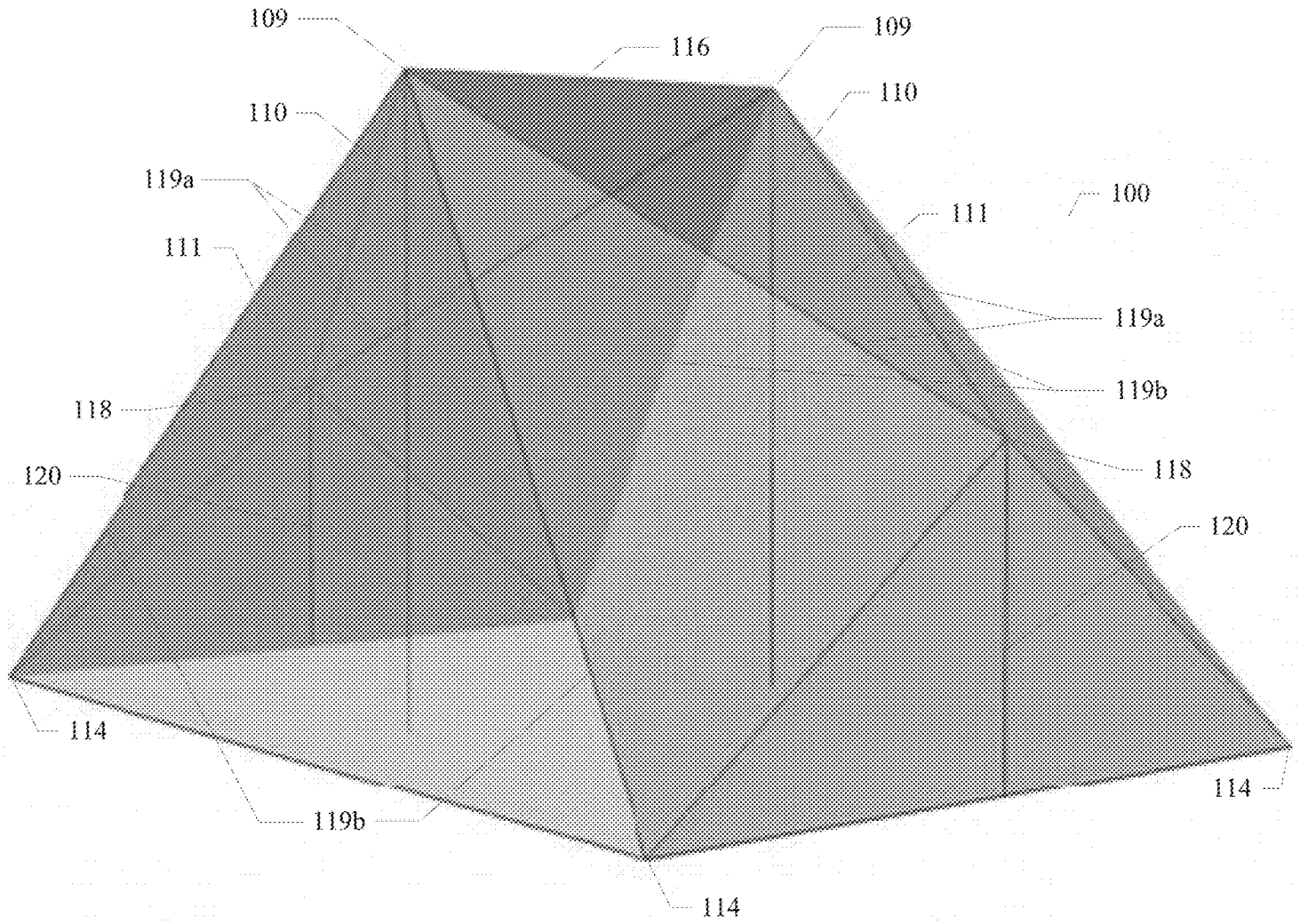
FIG. 4 illustrates an example embodiment of the tent shelter with apex poles proportionally displaced relative to a rectangular footprint and faceted, pole-supported sidewalls, the diagram showing the tent shelter with a canopy configured to form a plurality of isosceles trapezoids having two upper corners corresponding to the main canopy peaks, each isosceles trapezoid composed of four triangles offset from a plane of the isosceles trapezoid thereby forming an oblique pyramid with the isosceles trapezoid serving as a base of the oblique pyramid, the apex of the oblique pyramid corresponding to a secondary canopy peak.

FIG. 4 illustrates an example embodiment of the tent shelter 100 with apex poles 110 proportionally displaced relative to a rectangular footprint and faceted, pole-supported sidewalls, the diagram showing the tent shelter 100 with a canopy 111 configured to form a plurality of isosceles trapezoids having two upper corners corresponding to the main canopy peaks 109, each isosceles trapezoid composed of four triangles offset from a plane of the isosceles trapezoid thereby forming an oblique pyramid with the isosceles trapezoid serving as a base of the oblique pyramid, the apex of the oblique pyramid corresponding to a secondary canopy peak 118. The secondary poles (struts) 120, upon insertion into the secondary canopy peaks 118, tension the four triangles of each isosceles trapezoid at the apex of the oblique pyramid and along the edges of each triangle. As a result, the secondary poles (struts) 120 create beneficial tension at tension lines 119*a* through the tent fabric as described above. As also described above, these tension lines 119*a/b* create the individual triangles, facets, or panels, which partition the previously unsupported large tent fabric into a plurality of oblique pyramids having individual smaller panels, each of which has supported and tensioned edges. The result is a significantly stronger tent 100 structure in wind and other environmental forces. The extension of the canopy 111 into the oblique pyramid, faceted, pole-supported side walls also serves to substantially expand the useable interior space of the tent shelter 100, while maintaining the tent shelter 100 within the same footprint dimension. Thus, the example embodiments of the tent shelter 100 disclosed herein provide a structure with apex poles 110 proportionally displaced relative to a rectangular footprint and with faceted, pole-supported sidewalls.

Figure 5:
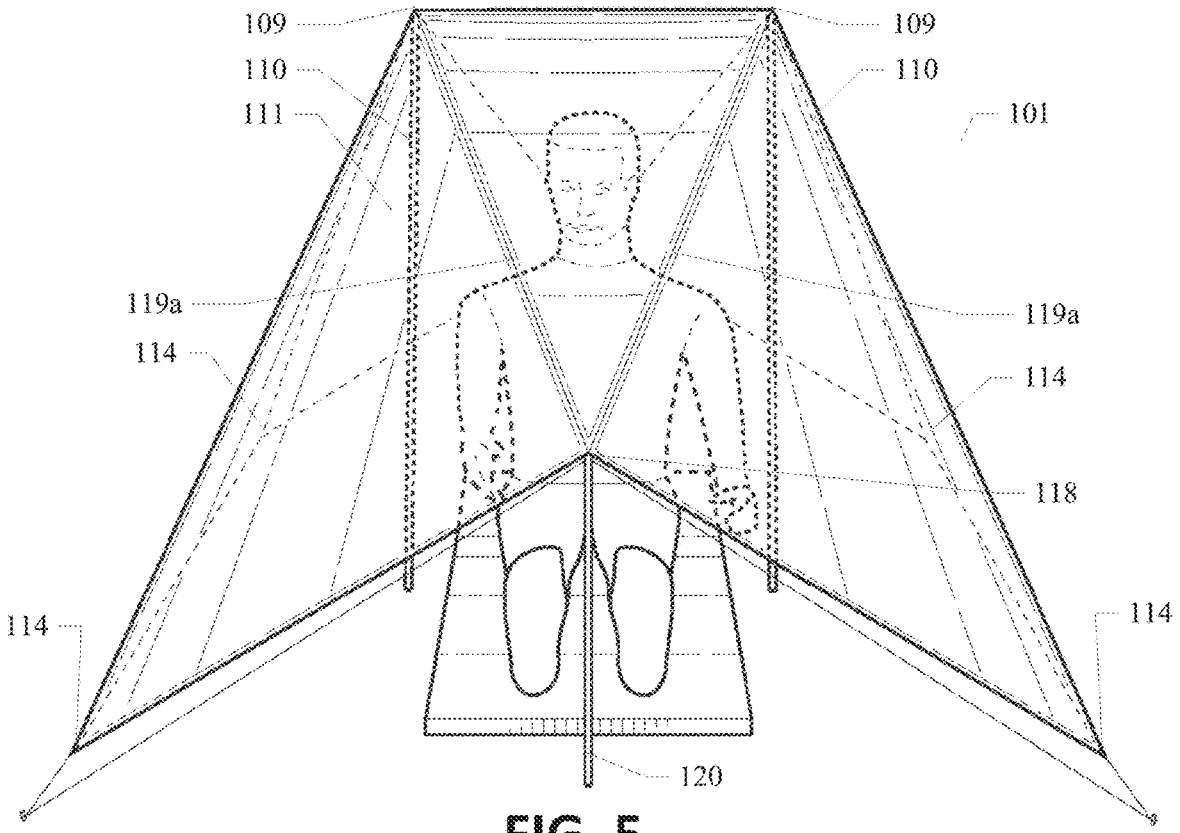
FIG. 5 illustrates a side view of an example embodiment of the tent shelter with apex poles proportionally displaced relative to a rectangular footprint and faceted, pole-supported sidewalls as configured for a single person.
Figure 6:
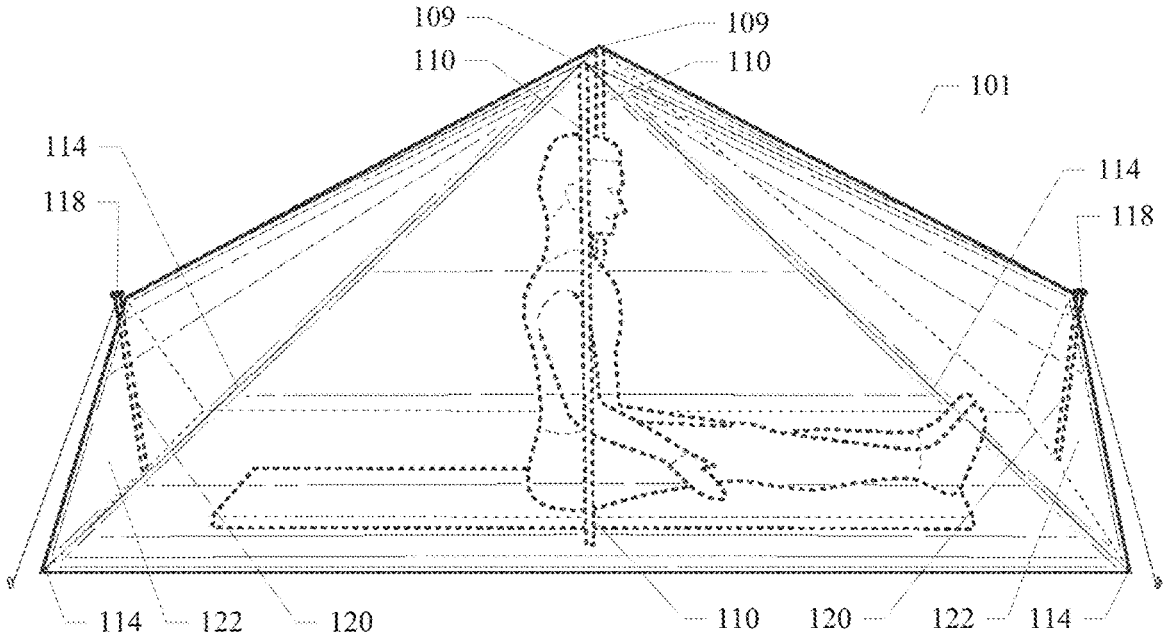
FIG. 6 illustrates a front view of an example embodiment of the tent shelter with apex poles proportionally displaced relative to a rectangular footprint and faceted, pole-supported sidewalls as configured for a single person.

Referring now to FIGS. 5 and 6, the diagrams illustrate a side view and front view of an example embodiment of the tent shelter 101 with displaced apex poles 110 as configured for a single person. FIGS. 5 and 6 also show an example embodiment of a "fly only" construction where the interior space is left open under the canopy. As shown and described above, the tent shelter 101 canopy can be staked at each of the four corners 114 of the canopy 111 perimeter, which defines the generally square or rectangular footprint. Apex poles 110 can be inserted upright through vents 117 or under the hem of the canopy 111 at ground level and into the main canopy peaks 109, thereby creating the longitudinal displacement 112 as described above. Additionally, the tent shelter 101 can provide secondary support poles (struts) 120 inserted into the two secondary canopy peaks 118. The secondary support poles (struts) 120 can be implemented as fixed-length or adjustable-length struts or poles. The secondary support poles (struts) 120 do not need to be staked into the ground. As a result, the disclosed tent shelter 101 addresses the usable volume and unsupported fabric span limitations of conventional A-frame tent designs. In particular, the disclosed improved A-frame tent 101 provides secondary support and lift by use of the secondary support poles (struts) 120. The secondary poles (struts) 120 not only increase the useable tent 101 interior volume; but the secondary poles (struts) 120 also create beneficial tension at tension lines 119*a* through the tent fabric. As described above, these tension lines 119*a/b* create individual facets or panels, which partition the previously unsupported large tent fabric into a plurality of individual smaller panels, each of which has supported and tensioned edges. The result is a significantly stronger tent 101 structure in wind and other environmental forces. Additionally, the improved A-frame tent 101 provides significantly more usable volume inside the tent. The design also creates vertical end walls 122 and allows for views and ventilation along all edges, which is impossible or impractical with the conventional A-frame designs. In the example embodiments, each secondary support pole (strut) 120 can be a foldable carbon fiber tube of a folded length that is convenient to store and pack in a backpack. For example, the foldable strut 120 can be configured in a stored size of the tent 101 structure (e.g., 12 inches folded and rolled), which easily fits into any standard backpack. In other example embodiments, each secondary support pole (strut) 120 can be any form of a vertical support pole, such as an adjustable-length or folded trekking pole, which is a viable option when users are carrying trekking poles or foldable arch poles.

Figure 7:
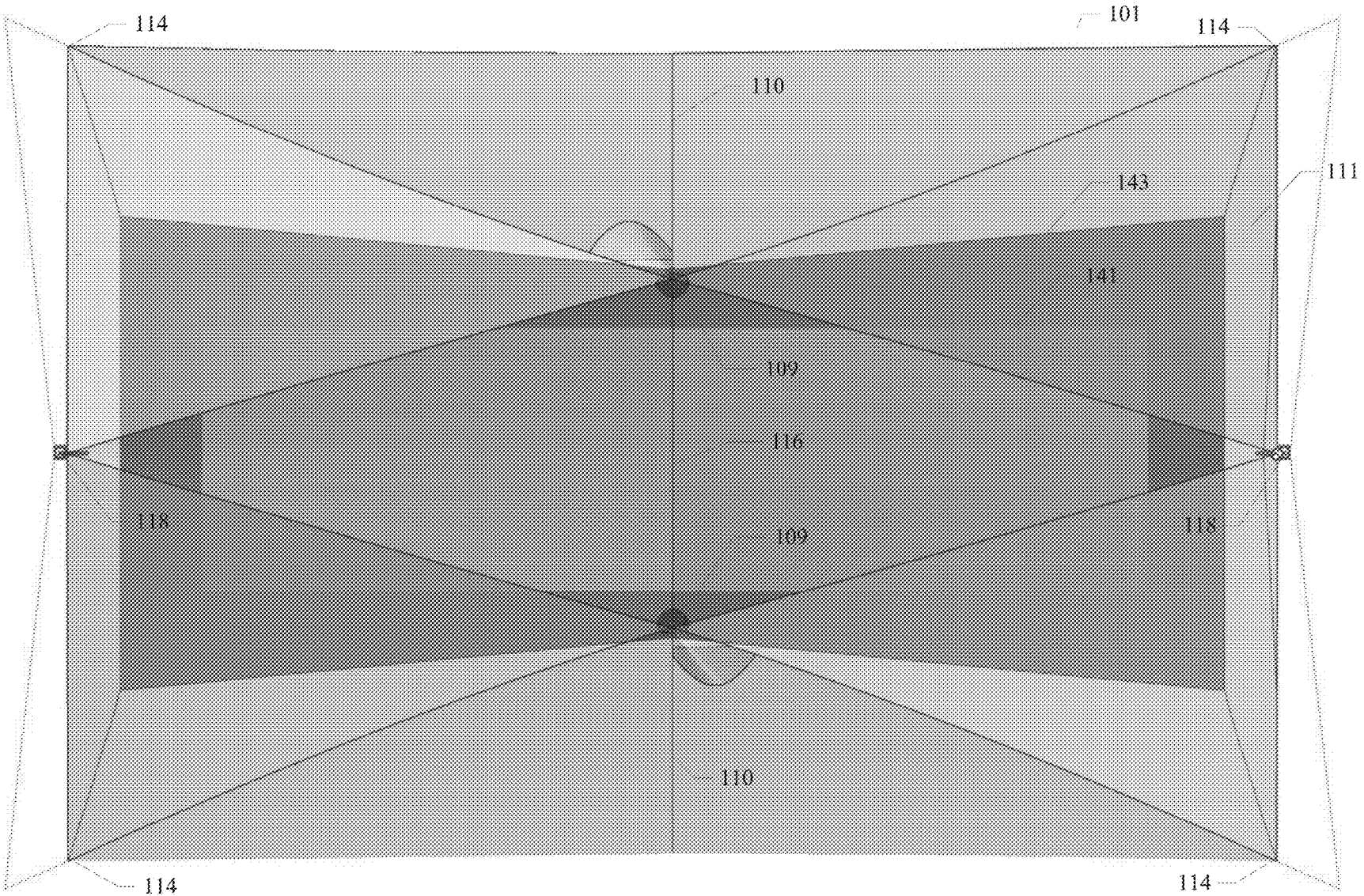
FIG. 7 illustrates a top-down view of an example embodiment of the tent shelter with apex poles proportionally displaced as configured for a single person, the diagram showing the various configurations for an interior living space with internal walls, floor, and sleeping area.

FIG. 7 illustrates a top-down view of an example embodiment of the tent shelter 101 with apex poles 110 proportionally displaced as configured for a single person. FIG. 7 shows the various configurations for an interior living space with internal walls, floor, and sleeping area. In the example embodiment of tent shelter 101 shown, the shelter 101 includes a weatherproof canopy 111 defining a generally square or rectangular footprint. The footprint can be fixed when the tent shelter 101 is erected by placing or fastening no more than four stakes to a ground surface at each of the four canopy corners 114 as shown in FIG. 7. Canopy 111 includes two main canopy peaks 109 adapted to receive the ends of upright apex poles 110. Canopy 111 further includes two secondary canopy peaks 118 adapted to receive the ends of secondary support poles (struts) 120. Main canopy peaks 109 are joined by a ridgeline 116, which may be a straight- or catenary-cut seam, or a bias line in the canopy fabric when the shelter is erected. The ridgeline 116 is configured to run substantially orthogonally with sides of the generally rectangular footprint.

Referring still to FIG. 7, the example embodiment of the tent shelter 101 is shown to include a sleeping pad or sleeping area 141 for a one person tent 101. FIG. 7 also illustrates the example embodiment of the tent shelter 101 with a floor surface 143 for the one person tent 101. The floor surface 143 can be a fabric layer sewn-in or removably attached to the interior of the canopy 111. Interior wall surfaces (not shown) can also be provided as fabric layers sewn-in or removably attached to the interior of the canopy 111. As a result, the example embodiment of the tent shelter 101 provides a closed interior space within the canopy 111. FIG. 7 illustrates the example embodiment of the tent shelter 101 with the sleeping area 141 in combination with the floor surface 143 for the one person tent 101.

Figure 8:
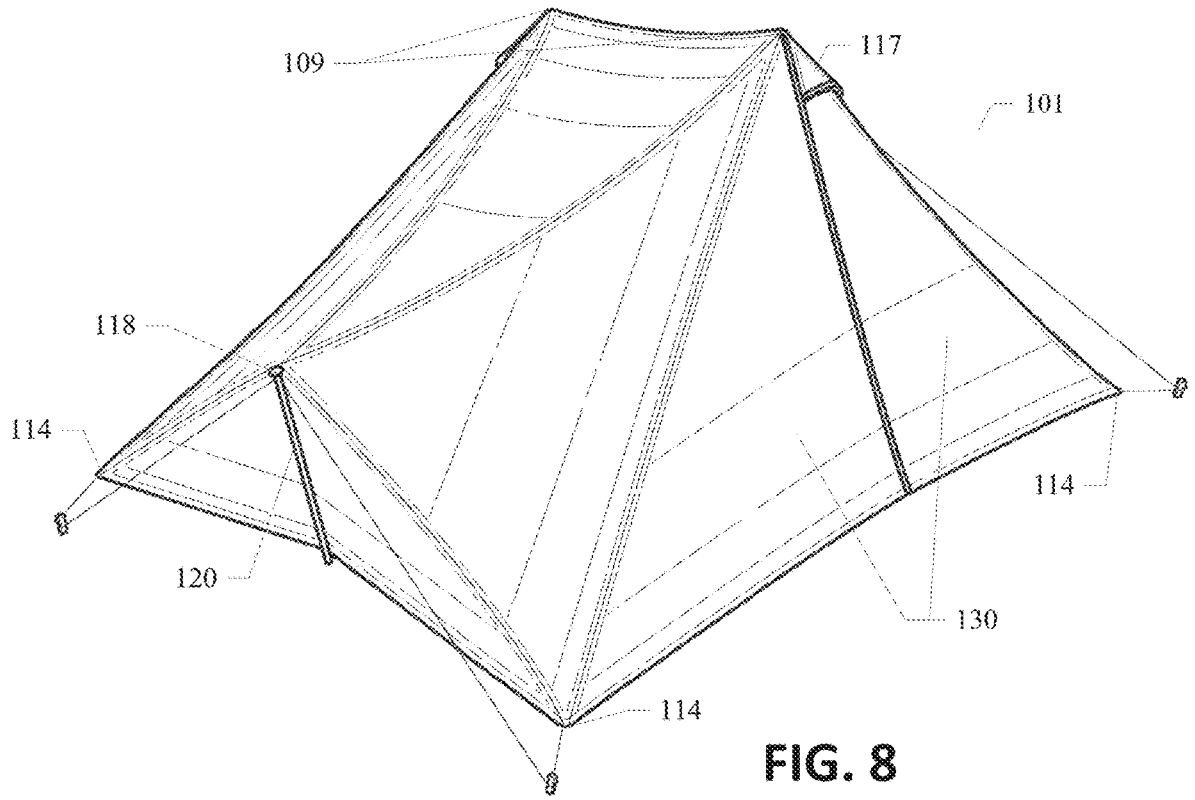
FIG. 8 illustrates a perspective view of an example embodiment of the tent shelter with apex poles proportionally displaced relative to a rectangular footprint and faceted, pole-supported sidewalls as configured for a single person, wherein the front panel or door is zipped closed.

FIG. 8 illustrates a perspective view of an example embodiment of the tent shelter 101 with displaced apex poles 110 as configured for a single person, wherein the front panel or door 130 is closed. A partition or separation in the front panel or door 130 can be provided with a zippered, hook and loop (Velcro™), snapped, or other closure mechanism to enable the front panel 130 to be opened or closed. As shown and described above, the tent shelter 101 canopy can be staked at each of the four corners 114 of the canopy 111 perimeter, which defines the generally square or rectangular footprint. Apex poles 110 can be inserted upright through vents 117 or under the hem of the canopy 111 at ground level and into the main canopy peaks 109, thereby creating the longitudinal displacement 112 as described above. Additionally, the tent shelter 101 can provide secondary support poles (struts) 120 inserted into the two secondary canopy peaks 118. In some cases, guy lines can be attached from each of the stakes at or near the four corners 114 to a tip of the secondary support poles (struts) 120 to provide additional support.

Figure 9:
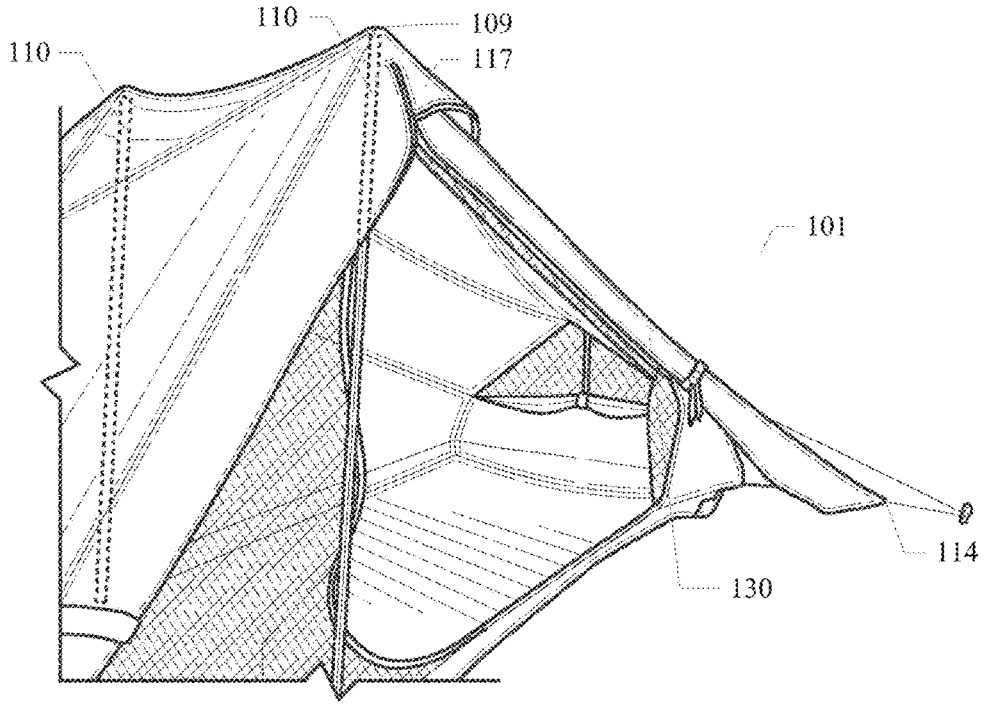
FIG. 9 illustrates a perspective view of an example embodiment of the tent shelter with apex poles proportionally displaced relative to a rectangular footprint and faceted, pole-supported sidewalls as configured for a single person, wherein the front panel or door is open.

FIG. 9 illustrates a perspective view of an example embodiment of the tent shelter 101 with displaced apex poles 110 as configured for a single person, wherein the front panel or door 130 is folded or rolled open. FIG. 9 also shows an example embodiment configured as a "single wall" construction where interior walls and a floor can be sewn in under the canopy to frame the interior space of the tent and provide a closed interior space. As shown, the interior of the tent shelter 101 provides an expanded usable volume by virtue of the displaced apex pole 110 configuration or longitudinal displacement 112 and the secondary support and lift provided by use of the secondary support poles (struts) 120 as disclosed herein. Additionally, an example embodiment can include a mesh layer on the front panel 130 to enable an optional complete sealed closure or vented closure of the front panel 130.

Figure 10:
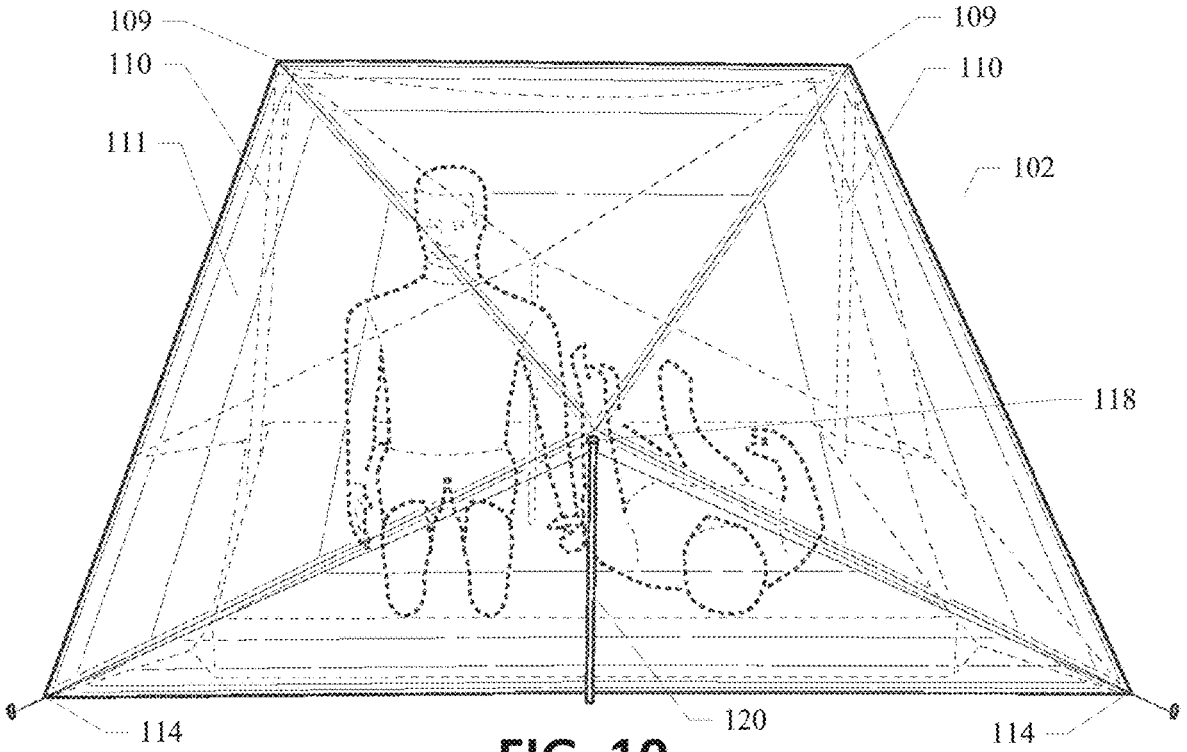
FIG. 10 illustrates a side view of an example embodiment of the tent shelter with apex poles proportionally displaced relative to a rectangular footprint and faceted, pole-supported sidewalls as configured for two people.
Figure 11:
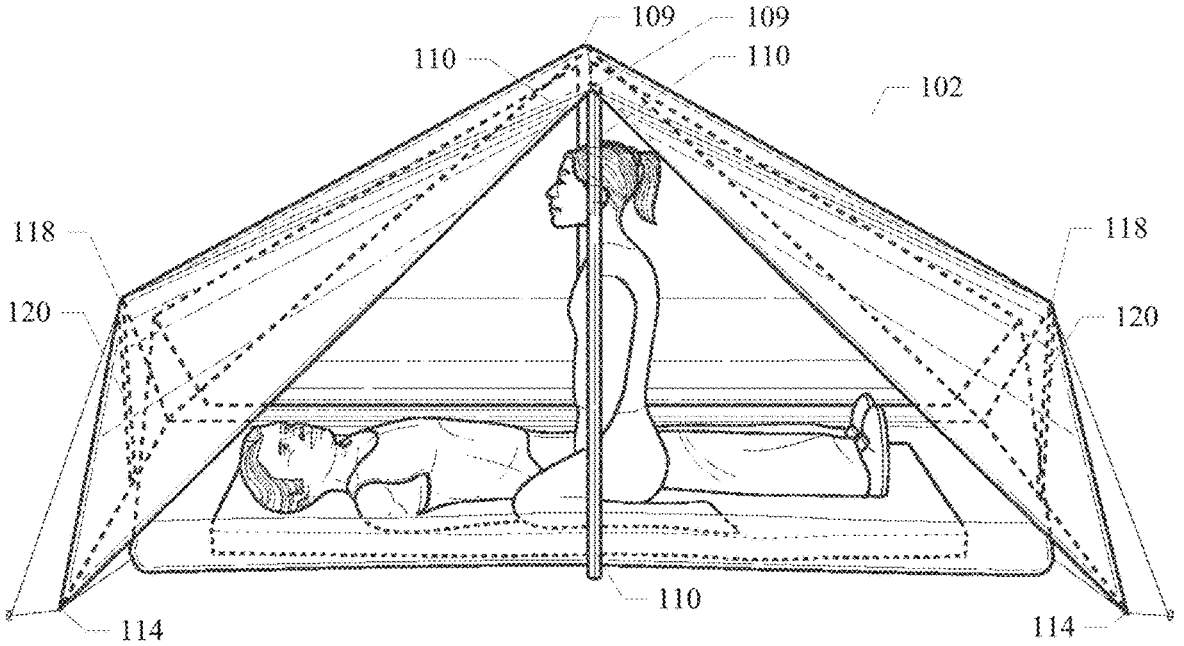
FIG. 11 illustrates a front view of an example embodiment of the tent shelter with apex poles proportionally displaced relative to a rectangular footprint and faceted, pole-supported sidewalls as configured for two people.

FIGS. 10 and 11 illustrate a side view and front view of an example embodiment of the tent shelter 102 with displaced apex poles 110 as configured for two people. FIG. 11 also shows (in dashed lines) an example embodiment configured as a "double wall" construction where interior walls and a floor can be removably attached or clipped in under the canopy to frame the interior space of the tent and provide a closed interior space. As shown and described above, the tent shelter 102 canopy can be staked at each of the four corners 114 of the canopy 111 perimeter, which defines the generally square or rectangular footprint. Apex poles 110 can be inserted upright through vents 117 or under the hem of the canopy 111 at ground level and into the main canopy peaks 109, thereby creating the longitudinal displacement 112 as described above. Additionally, the tent shelter 101 can provide secondary support poles (struts) 120 inserted into the two secondary canopy peaks 118. The secondary support poles (struts) 120 can be variable length struts, which may be shockcorded or segmented for a smaller packed size and easy assembly. Because of the larger canopy 111 in the example embodiment shown, the tent shelter 102 can accommodate two adults and their gear.

Figure 12:
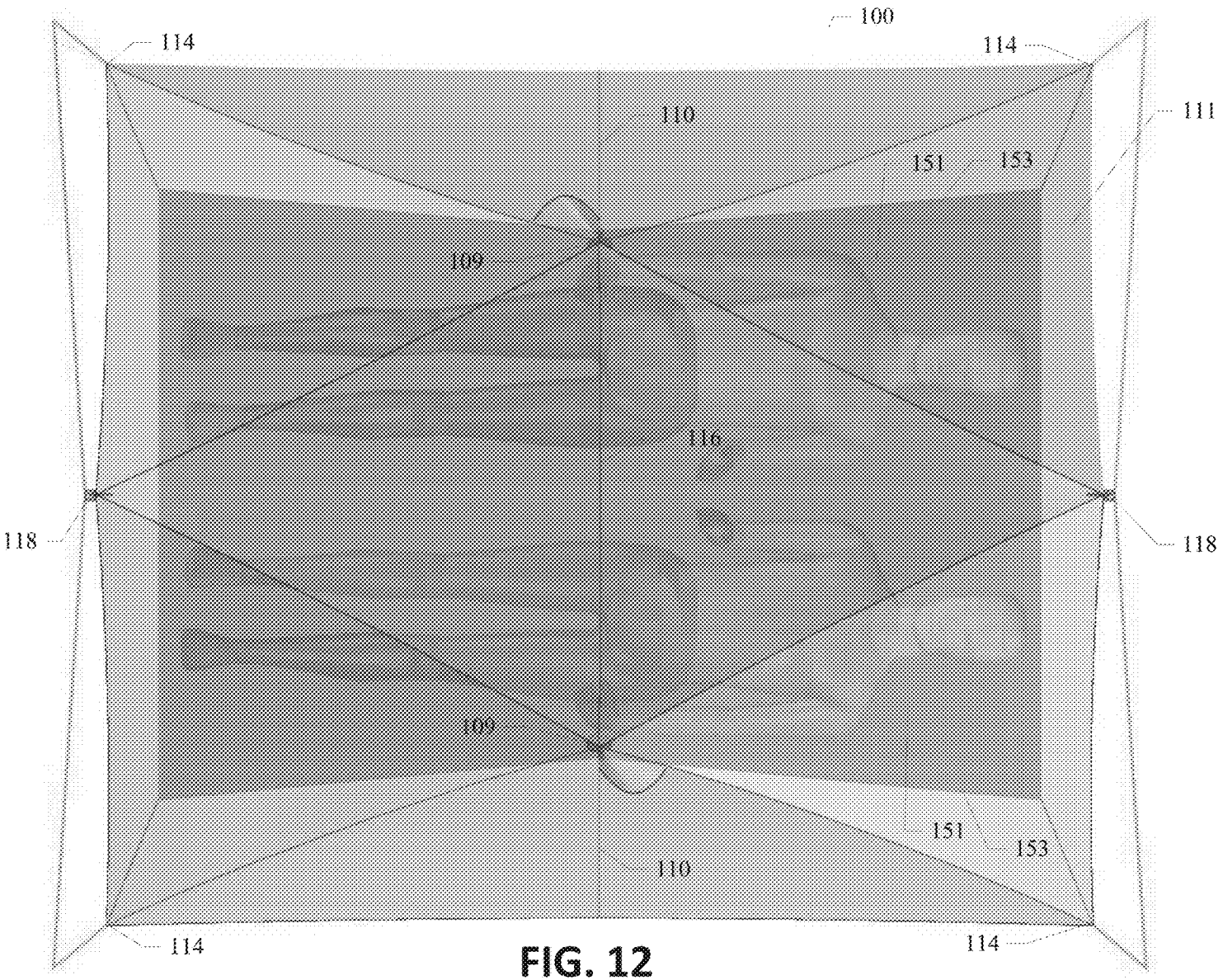
FIG. 12 illustrates a top-down view of an example embodiment of the tent shelter with apex poles proportionally displaced as configured for two people, the diagram showing the various configurations for an interior living space with internal walls, floor, and sleeping area.

FIG. 12 illustrates a top-down view of an example embodiment of the tent shelter 100 with apex poles 110 proportionally displaced as configured for two people, the diagram showing the various configurations for an interior living space with internal walls, floor, and sleeping area. In the example embodiment of tent shelter 100 shown, the shelter 100 includes a weatherproof canopy 111 defining a generally square or rectangular footprint. The footprint can be fixed when the tent shelter 100 is erected by placing or fastening no more than four stakes to a ground surface at each of the four canopy corners 114 as shown in FIG. 12. Canopy 111 includes two main canopy peaks 109 adapted to receive the ends of upright apex poles 110. Canopy 111 further includes two secondary canopy peaks 118 adapted to receive the ends of secondary support poles (struts) 120. Main canopy peaks 109 are joined by a ridgeline 116, which may be a straight- or catenary-cut seam, or a bias line in the canopy fabric when the shelter is erected. The ridgeline 116 is configured to run substantially orthogonally with sides of the generally rectangular footprint.

Referring to FIG. 12, the example embodiment of the tent shelter 100 is shown to include a sleeping pad or sleeping area 151 for a two person tent 100. FIG. 12 also illustrates the example embodiment of the tent shelter 100 with a floor surface 153 for the two person tent 100. The floor surface 153 can be a fabric layer sewn-in or removably attached to the interior of the canopy 111. Interior wall surfaces (not shown) can also be provided as fabric layers sewn-in or removably attached to the interior of the canopy 111. As a result, the example embodiment of the tent shelter 100 provides a closed interior space within the canopy 111. FIG. 12 illustrates the positioning of two people sheltered on sleeping area 151 within the tent 100.

Figure 13:
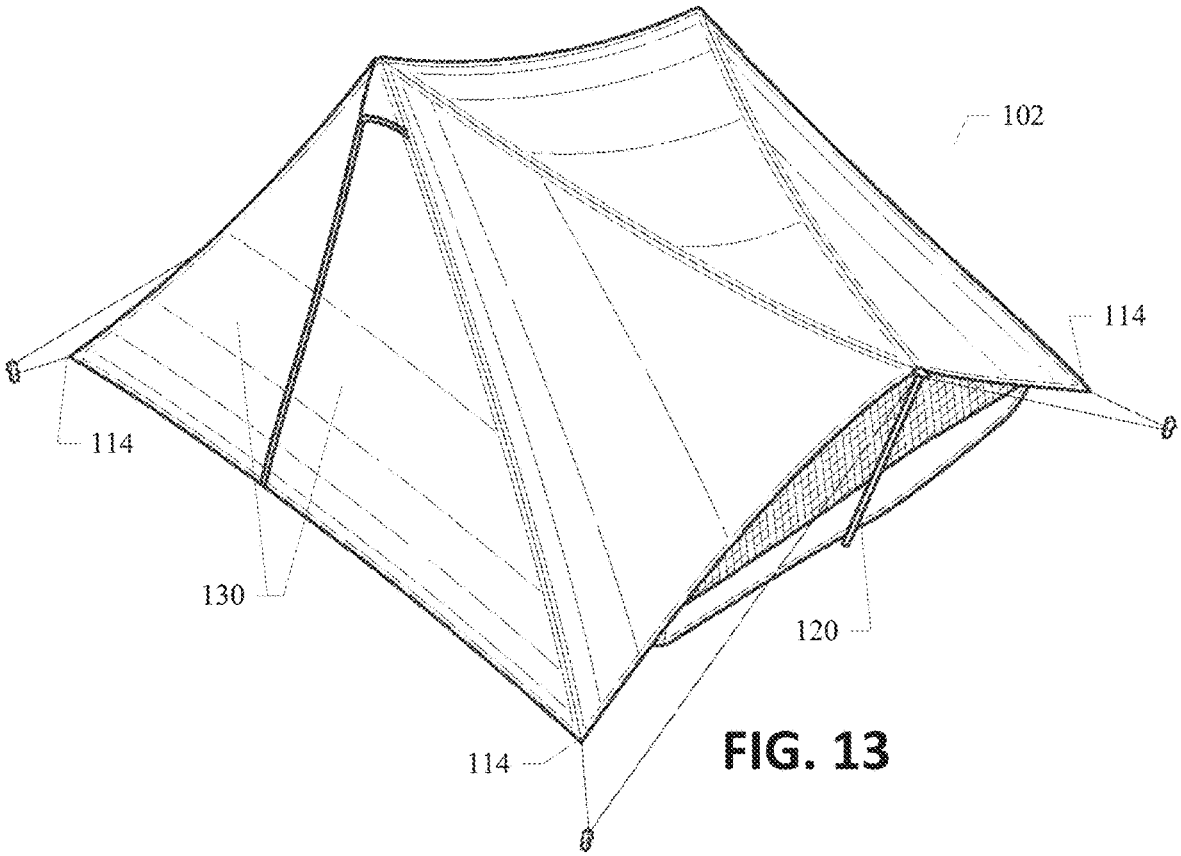
FIG. 13 illustrates a perspective view of an example embodiment of the tent shelter with apex poles proportionally displaced relative to a rectangular footprint and faceted, pole-supported sidewalls as configured for two people, wherein the front panel or door is zipped closed.

FIG. 13 illustrates a perspective view of an example embodiment of the tent shelter 102 with displaced apex poles 110 as configured for two people, wherein the front panel or door 130 is closed. A partition or separation in the front panel 130 can be provided with a zippered, hook and loop (Velcro™), snapped, or other closure mechanism to enable the front panel 130 to be opened or closed. As shown and described above, the tent shelter 102 canopy can be staked at each of the four corners 114 of the canopy 111 perimeter, which defines the generally square or rectangular footprint. Apex poles 110 can be inserted upright through vents 117 or under the hem of the canopy 111 at ground level and into the main canopy peaks 109, thereby creating the longitudinal displacement 112 as described above. Additionally, the tent shelter 102 can provide secondary support poles (struts) 120 inserted into the two secondary canopy peaks 118. In some cases, guy lines can be attached from each of the stakes at or near the four corners 114 to a tip of the secondary support poles (struts) 120 to provide additional support.

Figure 14:
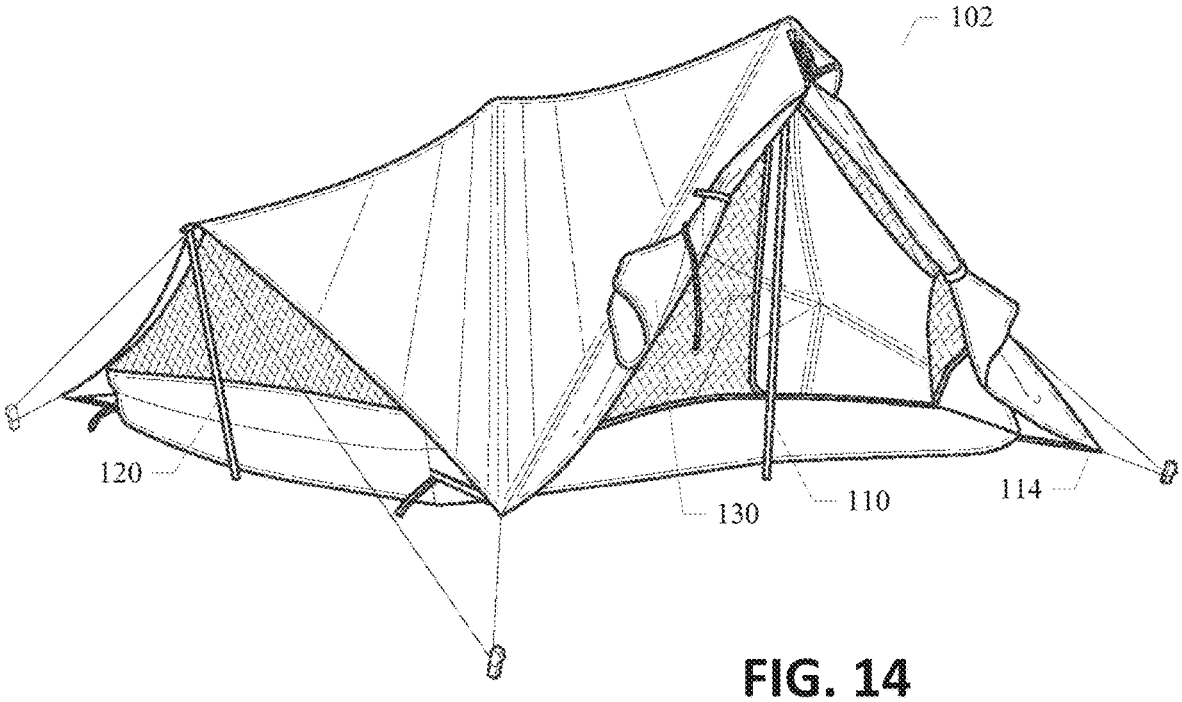
FIG. 14 illustrates a perspective view of an example embodiment of the tent shelter with apex poles proportionally displaced relative to a rectangular footprint and faceted, pole-supported sidewalls as configured for two people, wherein the front panel or door is open.

FIG. 14 illustrates a perspective view of an example embodiment of the tent shelter 102 with displaced apex poles 110 as configured for two people, wherein the front panel or door 130 is folded or rolled open. FIG. 14 also shows an example embodiment configured as a "single wall" construction where interior walls and a floor can be sewn in under the canopy to frame the interior space of the tent and provide a closed interior space. As shown, the interior of the tent shelter 101 provides an expanded usable volume by virtue of the displaced apex pole 110 configuration or longitudinal displacement 112 and the secondary support and lift provided by use of the secondary support poles (struts) 120 as disclosed herein. Additionally, an example embodiment can include a mesh layer on the front panel 130 to enable an optional complete sealed closure or vented closure of the front panel 130.

Figure 15:
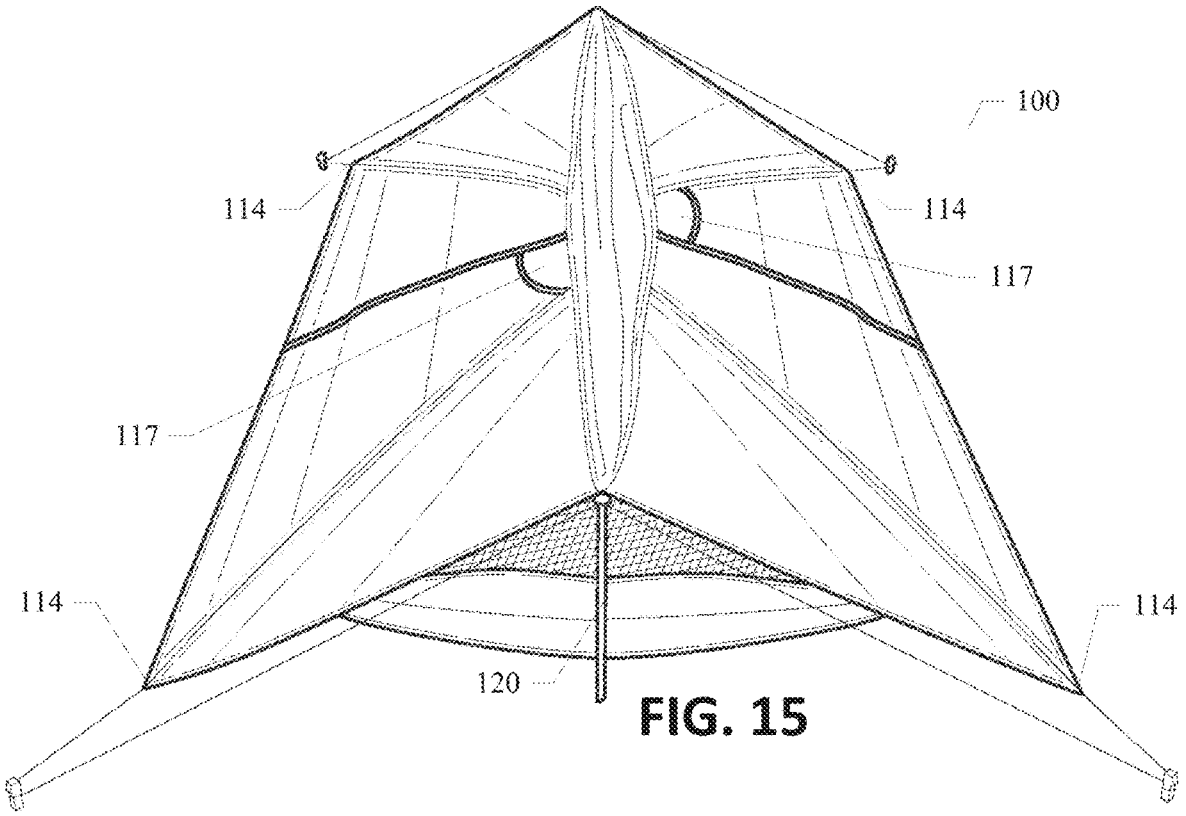
FIG. 15 illustrates an example embodiment of the tent shelter at setup with the four corners of the rectangular tent staked and the secondary support poles (struts) inserted, the example embodiment being shown prior to the insertion of the two apex poles.
Figure 16:
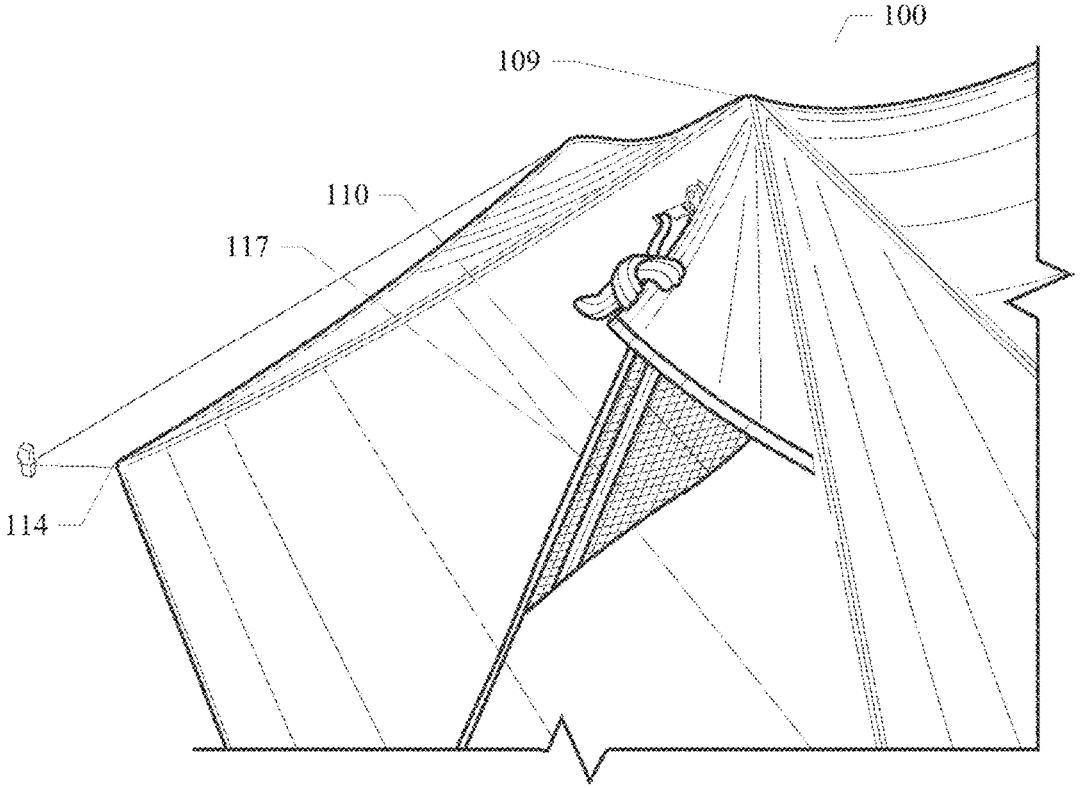
FIG. 16 illustrates an example embodiment of the tent shelter with zip open apex vents for ventilation and apex pole insertion at setup.

FIG. 15 illustrates an example embodiment of the tent shelter 100 at setup with the four corners 114 of the rectangular tent perimeter staked and the secondary support poles (struts) 120 inserted, the example embodiment being shown prior to the insertion of the two apex poles 110. In a next step of the setup process, the apex poles 110 can be inserted upright through vents 117 or under the hem of the canopy 111 at ground level and into the main canopy peaks 109. In a particular example embodiment, the secondary support poles (struts) 120 can be semi-permanently attached at manufacture to the secondary canopy peaks 118 and configured to spring into full extension when the tent shelter 100 is unfolded and erected. The result of the apex pole 110 insertion is shown in FIG. 16. FIG. 16 illustrates an example embodiment of the tent shelter 100 with the zip open apex vents 117 for ventilation and apex pole 110 insertion at setup.

Figure 17:
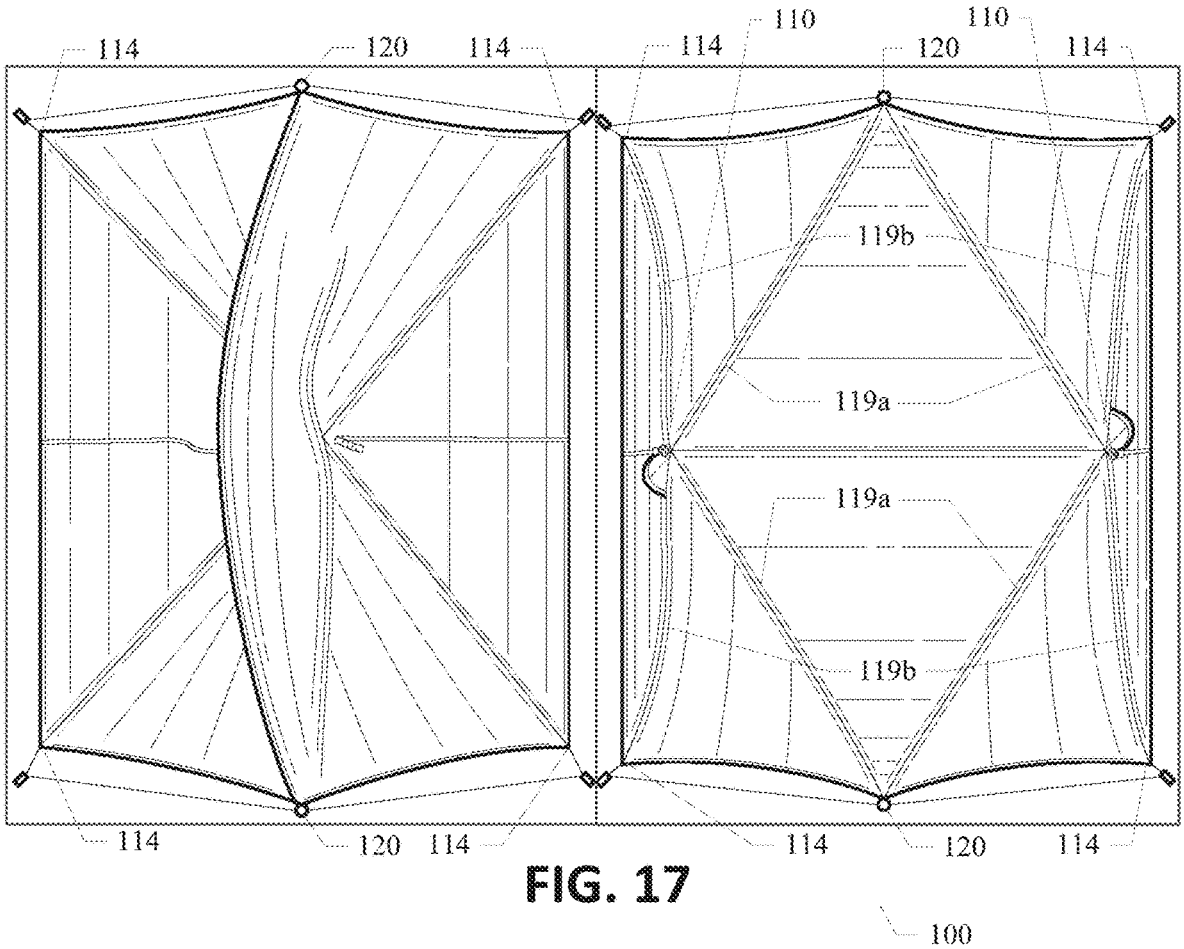
FIG. 17 illustrates a top-down view of an example embodiment of the tent shelter with an initial four-stake layout, for a two-person configuration, before and after insertion of the two vertical apex poles.

FIG. 17 illustrates a top-down view of an example embodiment of the tent shelter with an initial four-stake layout, for a two-person version, before and after insertion of the two vertical apex poles. As illustrated in the left-hand frame of FIG. 17, tent shelter 100 is shown at setup with each of the four corners 114 staked to the ground. The secondary support poles (struts) 120 have also been placed in the secondary canopy peaks 118 of tent shelter 100. Optional guy lines may also be attached between the four staked corners 114 and the secondary support poles (struts) 120 for additional stability. Prior to the insertion of the apex poles 110 as illustrated in the left-hand frame of FIG. 17, tent shelter 100 is deformed and collapsed. After the insertion of the apex poles 110 as illustrated in the right-hand frame of FIG. 17, tent shelter 100 is taut and sturdy. Because of the displaced apex pole 110 configuration or longitudinal displacement 112 as described above, the tension lines 119*a/b* are flexed and tight, thereby preventing rotation of the apex poles 110 and enabling the tent shelter 100 to resist environmental forces. The displaced apex pole 110 configuration also tightens the tension lines 119*a/b*, thereby fully opening the interior of the tent shelter 100 and creating a greater level of useable space within the tent shelter 100.

Figure 18:
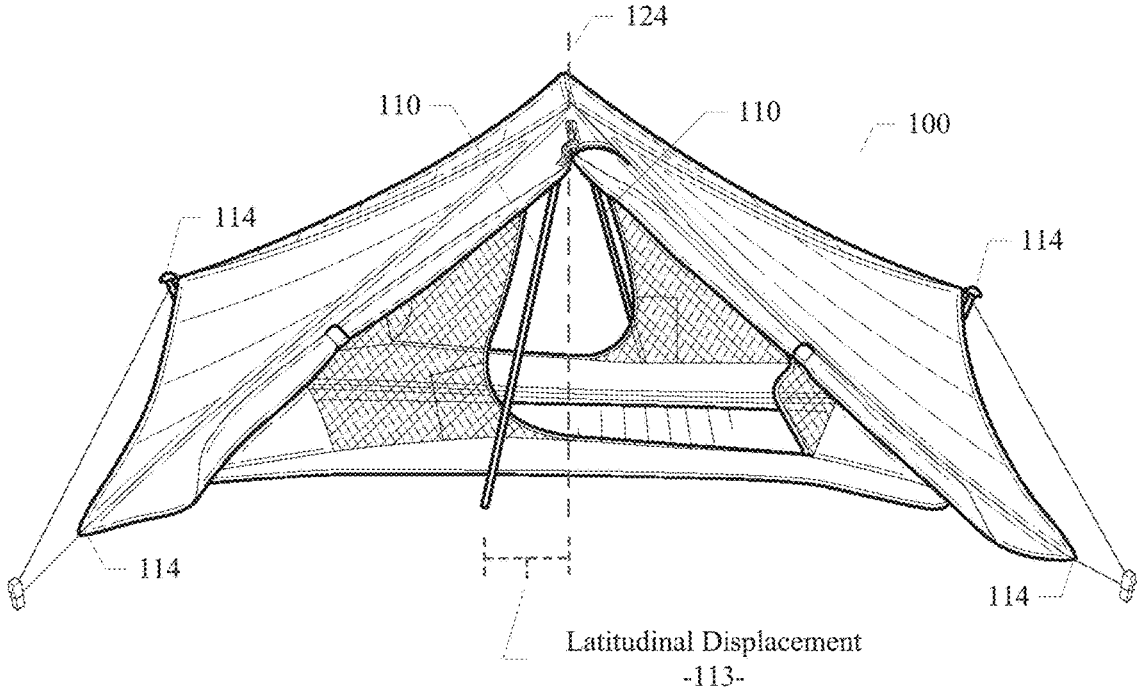
FIG. 18 illustrates a front view of an example embodiment of the tent shelter with apex poles proportionally displaced relative to a rectangular footprint and faceted, pole-supported sidewalls, wherein the apex poles are displaced both relative to a location where the low canopy corners tension to the ground (e.g., longitudinal displacement), and relative to a line connecting the tips of the two apex poles (e.g., latitudinal displacement)

FIG. 18 illustrates a front view of an example embodiment of the tent shelter 100 with displaced apex poles 110, wherein the apex poles 110 are displaced both in a longitudinal displacement 112 as described above, and displaced in a latitudinal displacement 113 relative to a line 124 connecting the tips of the two apex poles 110. FIG. 18 also shows an example embodiment configured as a "single wall" construction where interior walls and a floor can be sewn in under the canopy to frame the interior space of the tent and provide a closed interior space. In an example embodiment, the latitudinal displacement 113 can be a displacement of the apex poles 110 a desired distance perpendicular to the line 124. In the example embodiment shown in FIG. 18, the latitudinal displacement 113 can be an optional displacement of the apex poles 110 to provide an expanded opening of the tent shelter 100 for easier ingress and egress. The optional latitudinal displacement 113 can also be used for erecting the tent shelter 100 on uneven or non-level terrain.

Figure 19:
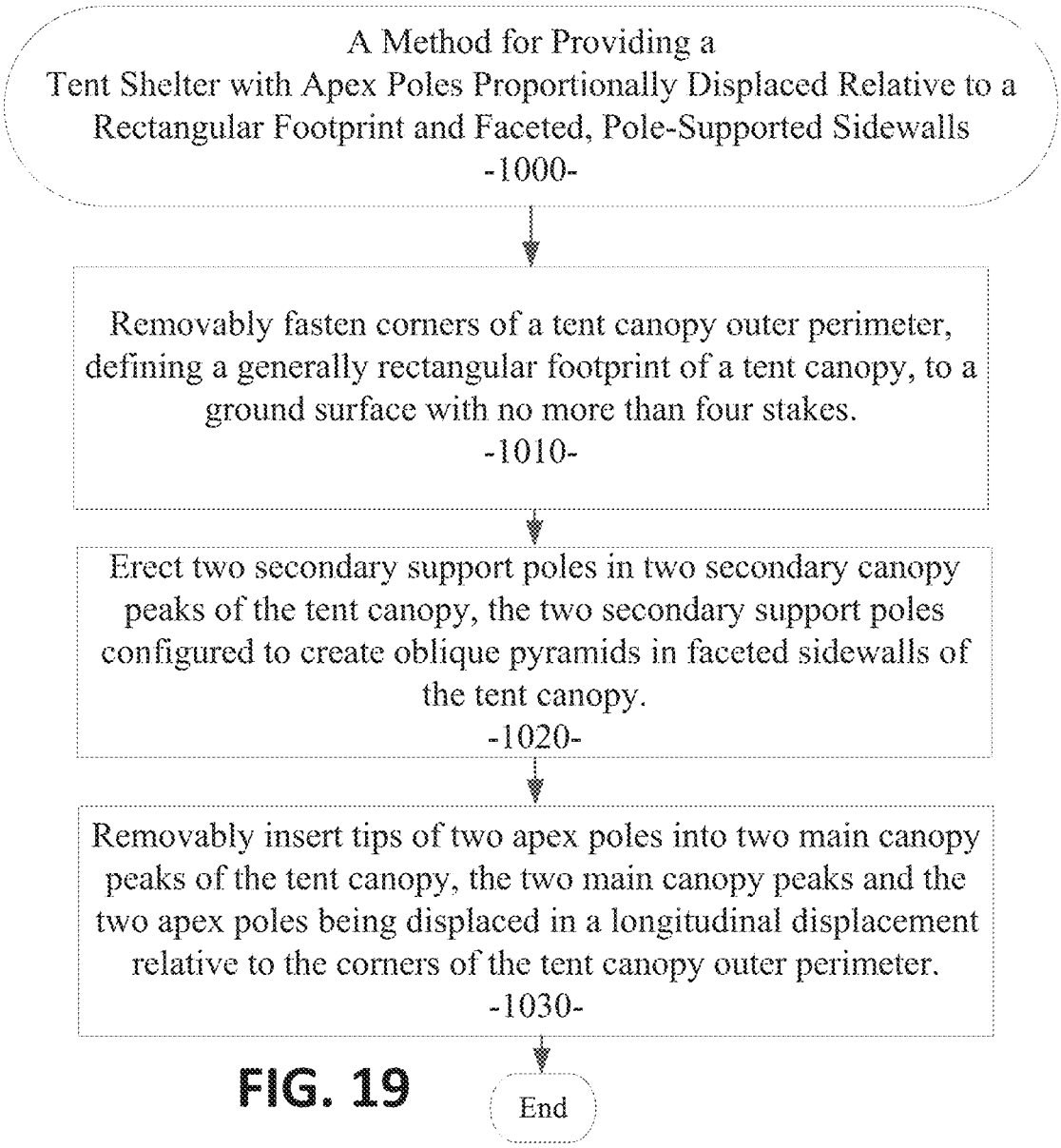
FIG. 19 illustrates a method according to and enabled by the structures and techniques disclosed herein.

FIG. 19 illustrates a method 1000 according to and enabled by the structures and techniques disclosed herein. In an example embodiment, method 1000 can include: removably fastening corners of a tent canopy outer perimeter, defining a generally rectangular footprint of a tent canopy, to a ground surface with no more than four stakes (operation 1010); erecting two secondary support poles in two secondary canopy peaks of the tent canopy, the two secondary support poles configured to create oblique pyramids in faceted sidewalls of the tent canopy (operation 1020); and removably inserting tips of two apex poles into two main canopy peaks of the tent canopy, the two main canopy peaks and the two apex poles being displaced in a longitudinal displacement relative to the corners of the tent canopy outer perimeter (operation 1030).

The illustrations of embodiments described herein are intended to provide a general understanding of the structure of various embodiments, and they are not intended to serve as a complete description of all the elements and features of components and systems that might make use of the structures described herein. Many other embodiments will be apparent to those of ordinary skill in the art upon reviewing the description provided herein. Other embodiments may be utilized and derived, such that structural and logical substitutions and changes may be made without departing from the scope of this disclosure. The figures herein are merely representational and may not be drawn to scale. Certain proportions thereof may be exaggerated, while others may be minimized. Accordingly, the specification and drawings are to be regarded in an illustrative rather than a restrictive sense.

The description herein may include terms, such as "up", "down", "upper", "lower", "first", "second", etc. that are used only for descriptive purposes and not to be construed as limiting. The elements, materials, geometries, dimensions, and sequence of operations may all be varied for particular applications. Parts of some embodiments may be included in, or substituted for, those of other embodiments. While the foregoing examples of dimensions and ranges are considered typical, the various embodiments are not limited to such dimensions or ranges.

The Abstract is provided to allow the reader to quickly ascertain the nature and gist of the technical disclosure. The Abstract is submitted with the understanding that it will not be used to interpret or limit the scope or meaning of the claims. In the foregoing Detailed Description, various features are grouped together in a single embodiment for the purpose of streamlining the disclosure. This method of disclosure is not to be interpreted as reflecting an intention that the claimed embodiments have more features than are expressly recited in each claim. Thus, the following claims are hereby incorporated into the Detailed Description, with each claim standing on its own as a separate embodiment.

As described herein, a tent shelter with apex poles proportionally displaced relative to a rectangular footprint and faceted, pole-supported sidewalls is disclosed. Although the disclosed subject matter has been described with reference to several example embodiments, it may be understood that the words that have been used are words of description and illustration, rather than words of limitation. Changes may be made within the purview of the appended claims, as presently stated and as amended, without departing from the scope and spirit of the disclosed subject matter in all its aspects. Although the disclosed subject matter has been described with reference to particular means, materials, and embodiments, the disclosed subject matter is not intended to be limited to the particulars disclosed; rather, the subject matter extends to all functionally equivalent structures, methods, and uses such as are within the scope of the appended claims.

What is claimed is:

1. A tent shelter comprising:

a tent canopy having an outer perimeter defining a generally rectangular footprint, the tent canopy configured with corners at the outer perimeter for removable fastening of the tent canopy outer perimeter to a ground surface with no more than four stakes, the tent canopy further including tension lines, which partition the tent canopy into a plurality of individual facets or panels, two apex poles, the tent canopy having two main canopy peaks configured to receive tips of the two apex poles removably insertable therein, the two main canopy peaks and the two apex poles being displaced in a longitudinal displacement relative to the corners of the tent canopy outer perimeter; and two secondary support poles, the tent canopy also having two secondary canopy peaks configured with two secondary support poles erectable therein, the two secondary support poles configured to create oblique pyramids in faceted sidewalls of the tent canopy.

2. The tent shelter of claim 1 wherein the longitudinal displacement is at least ten (10) inches.

3. The tent shelter of claim 1 wherein a longitudinal displacement angle is less than or equal to 78 degrees, the longitudinal displacement angle being formed by a first line connecting a corner of the tent canopy outer perimeter with one of the two main canopy peaks having one of the two apex poles inserted therein, and a second line connecting the corner of the tent canopy outer perimeter with a lower end of the inserted apex pole.

4. The tent shelter of claim 1 wherein the two apex poles are any form of a vertical support pole, or an adjustable-length hiking or trekking pole.

5. The tent shelter of claim 1 wherein the two secondary support poles are any form of a vertical support pole, or an adjustable-length hiking or trekking pole.

6. The tent shelter of claim 1 wherein a length of the two apex poles is greater than a length of the two secondary support poles.

7. The tent shelter of claim 1 wherein the tent shelter is configurable in a single person version, a two person version, or a version sheltering more than two people.

8. The tent shelter of claim 1 wherein a ridgeline connecting the two main canopy peaks of the tent canopy is substantially orthogonal with sides of the generally rectangular footprint.

9. The tent shelter of claim 1 wherein the two main canopy peaks and the two secondary canopy peaks are positioned substantially near mid-points of sides of the generally rectangular footprint.

10. The tent shelter of claim 1 wherein the longitudinal displacement of the apex poles is configured to prevent inward rotation of the apex poles and does not require guy lines attached to the tips of the two apex poles.

11. A method comprising:

removably fastening corners of a tent canopy outer perimeter, defining a generally rectangular footprint of a tent canopy, to a ground surface with no more than four stakes, the tent canopy including tension lines, which partition the tent canopy into a plurality of individual facets or panels;

erecting two secondary support poles in two secondary canopy peaks of the tent canopy, the two secondary support poles configured to create oblique pyramids in faceted sidewalls of the tent canopy; and removably inserting tips of two apex poles into two main canopy peaks of the tent canopy, the two main canopy peaks and the two apex poles being displaced in a longitudinal displacement relative to the corners of the tent canopy outer perimeter.

12. The method of claim 11 wherein the longitudinal displacement is at least ten (10) inches.

13. The method of claim 11 wherein the two apex poles are displaced at a longitudinal displacement angle of less than or equal to 78 degrees, the longitudinal displacement angle being formed by a first line connecting a corner of the tent canopy outer perimeter with one of the two main canopy peaks having one of the two apex poles inserted therein, and a second line connecting the corner of the tent canopy outer perimeter with a lower end of the inserted apex pole.

14. The method of claim 11 wherein the two apex poles are any form of a vertical support pole, or an adjustable-length hiking or trekking pole.

15. The method of claim 11 wherein the two secondary support poles are any form of a vertical support pole, or an adjustable-length hiking or trekking pole.

16. The method of claim 11 wherein a length of the two apex poles is greater than a length of the two secondary support poles.

17. The method of claim 12 wherein the tent shelter is configurable in a single person version, a two person version, or a version sheltering more than two people.

18. The method of claim 12 wherein a ridgeline connecting the two main canopy peaks of the tent canopy is substantially orthogonal with sides of the generally rectangular footprint.

19. The method of claim 12 wherein the two main canopy peaks and the two secondary canopy peaks are positioned substantially near mid-points of sides of the generally rectangular footprint.

20. The method of claim 12 wherein the longitudinal displacement of the apex poles prevents inward rotation of the apex poles and does not require guy lines attached to the tips of the two apex poles.

* * * * *